US008814390B1

(12) United States Patent
Chuan et al.

(10) Patent No.: US 8,814,390 B1
(45) Date of Patent: Aug. 26, 2014

(54) LED LIGHT APPARATUS

(71) Applicant: OptoElectronix, Inc., San Jose, CA (US)

(72) Inventors: Kow Chuong Chuan, San Jose, CA (US); Yap Peng Hooi, San Jose, CA (US); Kok Chin Vooi, San Jose, CA (US); Jebby Foo Heng Kiat, San Jose, CA (US)

(73) Assignee: OptoElectronix, Inc., San Jose, CA (US)

( * ) Notice: Subject to any disclaimer, the term of this patent is extended or adjusted under 35 U.S.C. 154(b) by 0 days.

(21) Appl. No.: 13/875,703

(22) Filed: May 2, 2013

Related U.S. Application Data

(60) Provisional application No. 61/641,701, filed on May 2, 2012.

(51) Int. Cl.

| | |
|---|---|
| ***F21V 5/04*** | (2006.01) |
| ***F21V 29/00*** | (2006.01) |
| ***F21V 19/00*** | (2006.01) |
| ***H05B 33/02*** | (2006.01) |
| ***F21V 21/00*** | (2006.01) |
| *F21V 29/02* | (2006.01) |

(52) U.S. Cl.

CPC ..... *H05B 33/02* (2013.01); *F21V 29/22* (2013.01); *F21V 29/02* (2013.01); *F21V 29/004* (2013.01); *F21V 29/00* (2013.01); *F21V 21/00* (2013.01)

USPC ..... 362/249.02; 362/249.01; 362/235; 362/311.02; 362/373; 362/294

(58) Field of Classification Search

CPC ..... F21V 5/00; F21V 5/001; F21V 5/04; F21V 5/046; F21V 29/00; F21V 29/002; F21V 29/004; F21V 29/02; F21V 29/20; F21V 29/22; F21V 29/2293

USPC ..... 313/46; 362/249.01, 249.02, 235, 257, 362/311.01–311.15, 373, 294, 345

See application file for complete search history.

(56) References Cited

U.S. PATENT DOCUMENTS

| | | | | |
|---|---|---|---|---|
| 5,567,036 | A * | 10/1996 | Theobald et al. | 362/485 |
| 5,796,210 | A | 8/1998 | Sakakibara | |
| 6,193,390 | B1 | 2/2001 | Sakakibara | |
| 6,422,721 | B1 | 7/2002 | Plunk | |
| 6,762,562 | B2 | 7/2004 | Leong | |
| 6,908,212 | B2 | 6/2005 | Schultz | |
| 6,921,182 | B2 | 7/2005 | Anderson | |
| 7,018,070 | B2 | 3/2006 | McCoy | |
| 7,234,842 | B2 | 6/2007 | Frederico | |
| 7,507,001 | B2 | 3/2009 | Kit | |
| 7,635,201 | B2 | 12/2009 | Deng | |
| D608,928 | S | 1/2010 | Noh | |
| D614,323 | S | 4/2010 | Stewart | |
| D615,223 | S | 5/2010 | Huang | |
| 7,722,221 | B2 | 5/2010 | Chae | |
| D627,905 | S | 11/2010 | Swafford, Jr. | |
| 8,240,880 | B2 * | 8/2012 | Chen et al. | 362/247 |
| 8,282,240 | B2 * | 10/2012 | Xiao et al. | 362/249.02 |
| 2006/0274526 | A1 * | 12/2006 | Weston et al. | 362/252 |

(Continued)

*Primary Examiner* — Mariceli Santiago

(74) *Attorney, Agent, or Firm* — Fernandez & Associates, LLP

(57) ABSTRACT

A LED based lighting apparatus comprising a low cost stamped frame comprising structural elements, LED attach region at a predetermined tilt angle and heat sink region enabling a lamp with uniform lighting distribution is disclosed.

13 Claims, 10 Drawing Sheets

(56) References Cited

U.S. PATENT DOCUMENTS

| | | | | |
|---|---|---|---|---|
| 2008/0094837 | A1 | 4/2008 | Dobbins | |
| 2009/0201679 | A1 | 8/2009 | Konaka | |
| 2009/0261706 | A1 | 10/2009 | Sorella | |
| 2010/0157595 | A1* | 6/2010 | Lin et al. | 362/235 |
| 2010/0214779 | A1 | 8/2010 | Kao | |
| 2011/0156584 | A1 | 6/2011 | Kim | |
| 2011/0169408 | A1 | 7/2011 | Chen | |
| 2012/0250323 | A1* | 10/2012 | Velu | 362/249.02 |

* cited by examiner

Incandescent Bulb

Conventional LED Light

LED Lighting Apparatus

Figure 2A Metal Stamped Frame for circular LED Lighting Apparatus
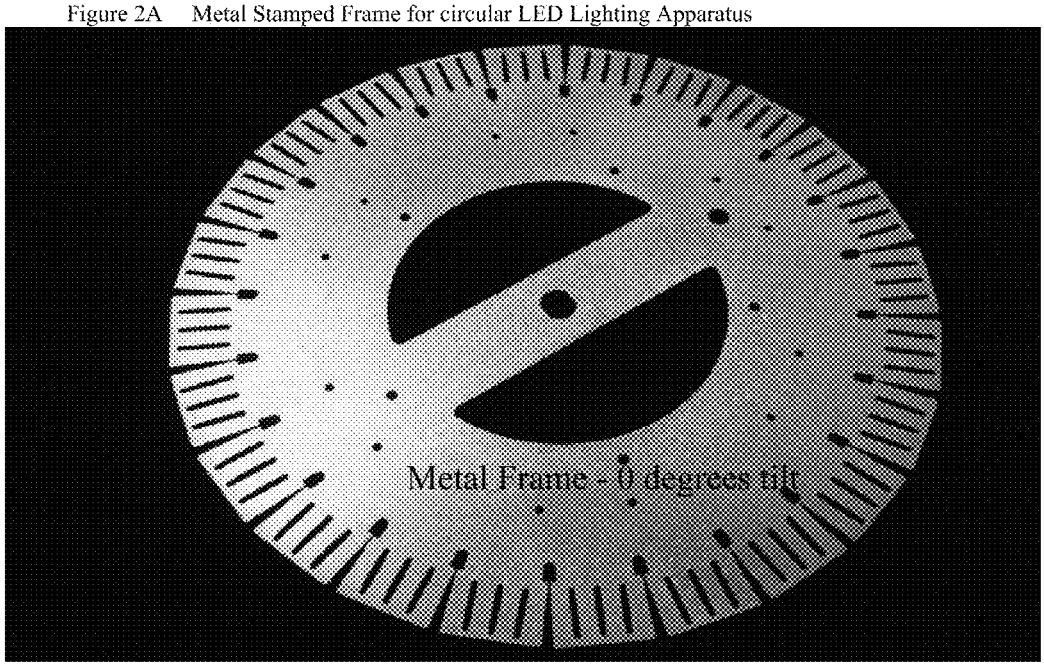
Figure 2B Metal Stamped Frame
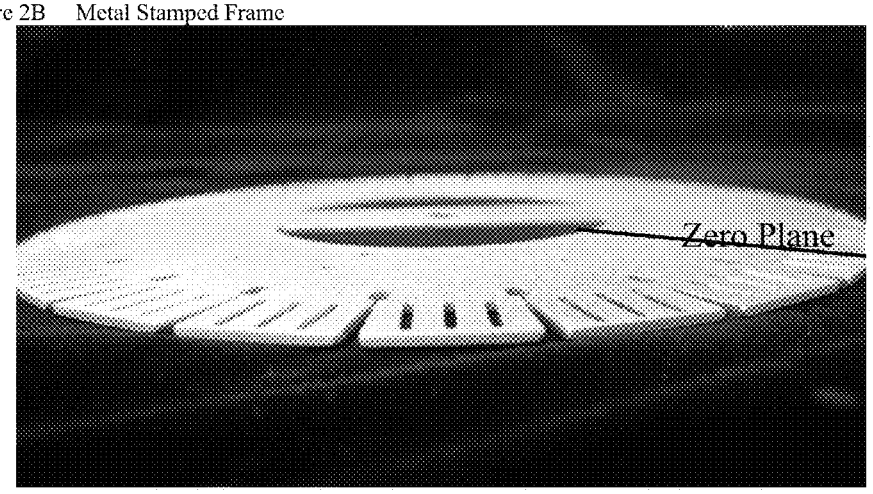

Figure 2C Alternative Metal Stamped Frame with tilt angle
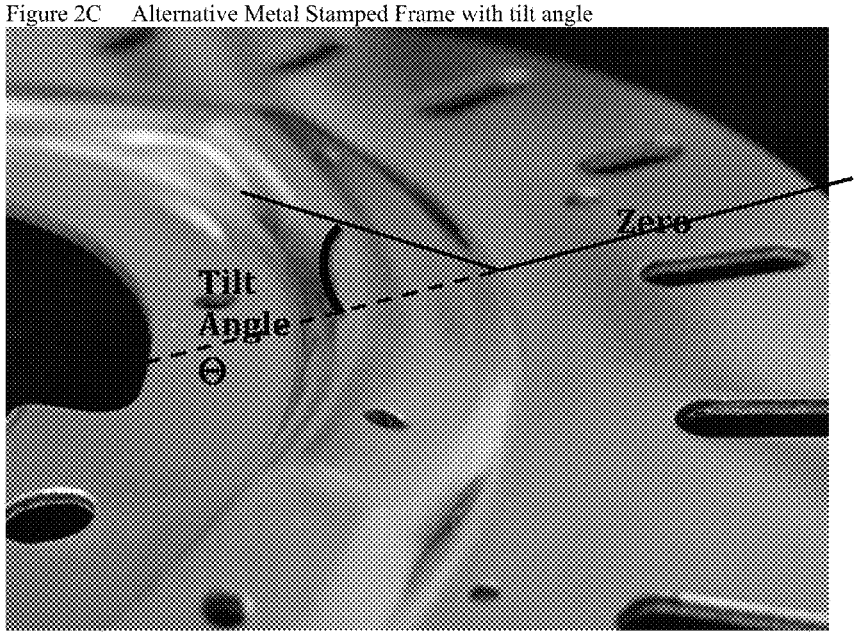
Figure 2D Alternative Metal Stamped Frame with tilt angle
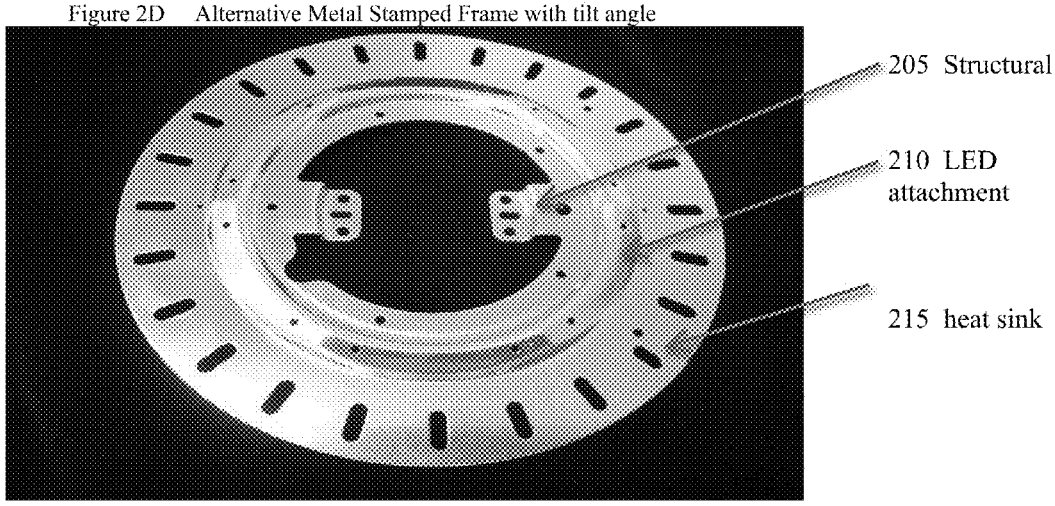

Figure 3A Circular lamp
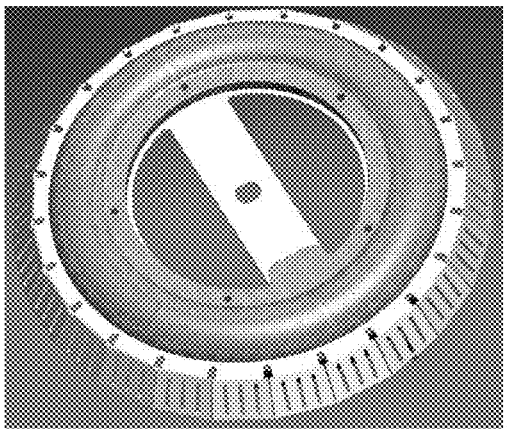
Figure 3B Alternative shape
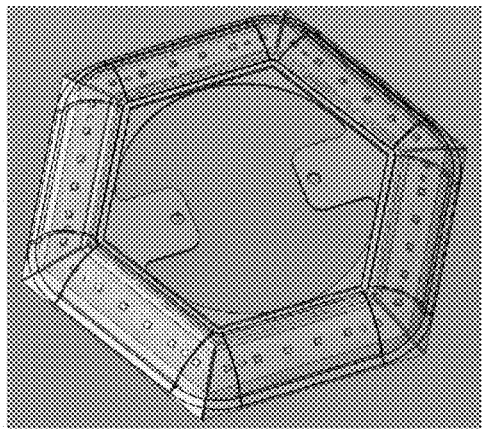
Figure 3C Heat-sink - 18 degrees tilt with LEDs
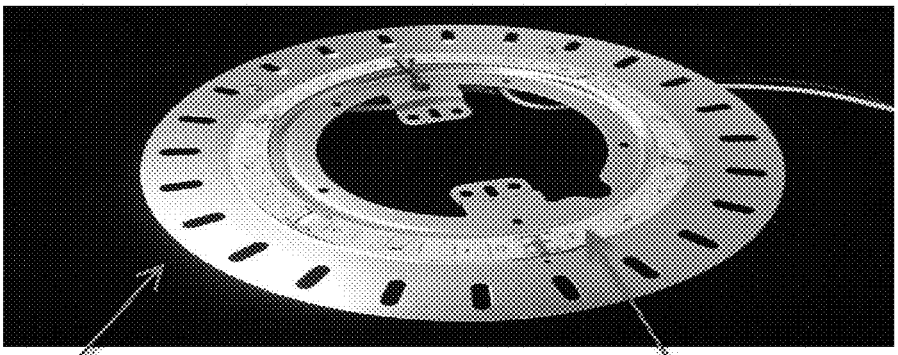

Figure 3D Heat-sink - with LEDs at tilt angle
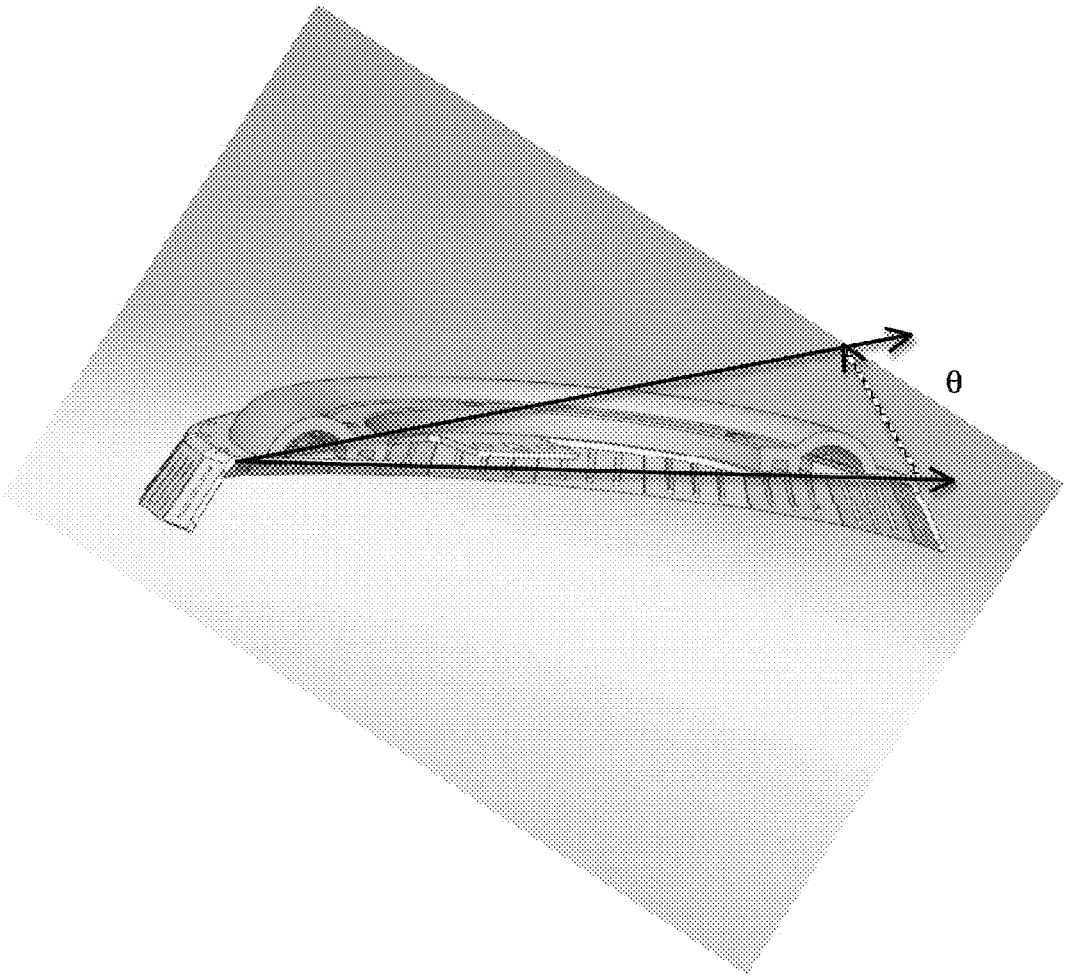

Straight-cut Heat-sink

Bent Heat-sink

Supplementary Heat-sink

Figure 6A
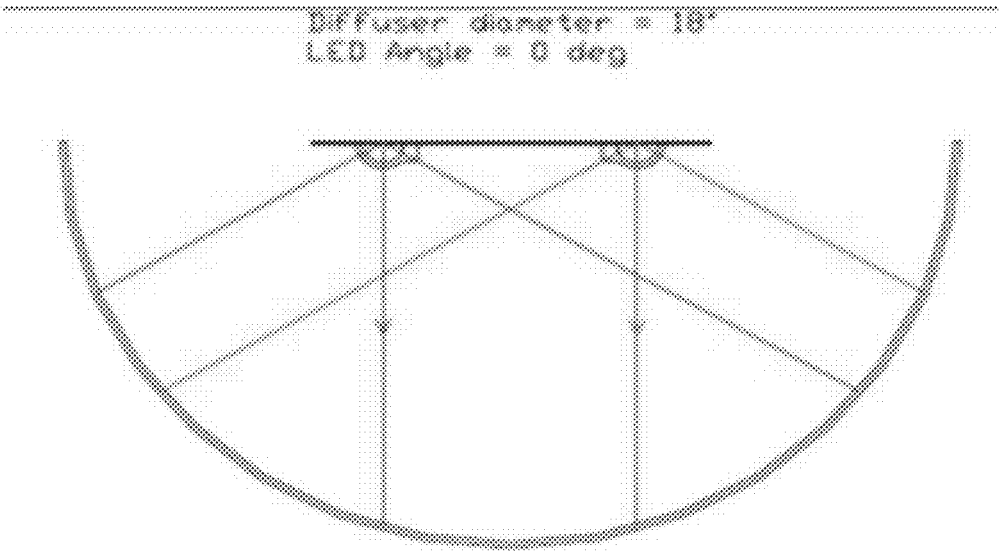
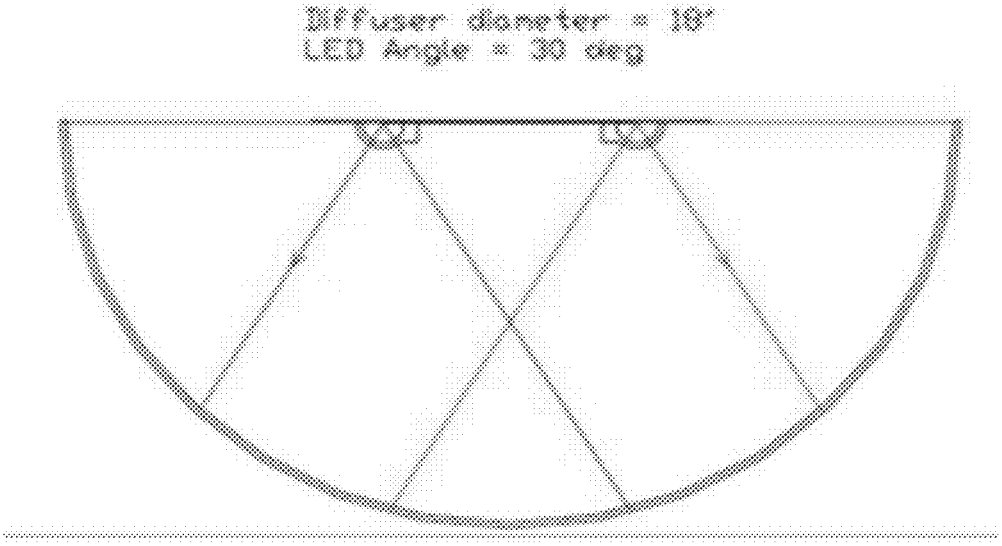
Figure 6B

Figure 7 12" Diffuser with 8" stamped frame and LED attach at 5.23" dia. and $\Theta = 18^{o}$
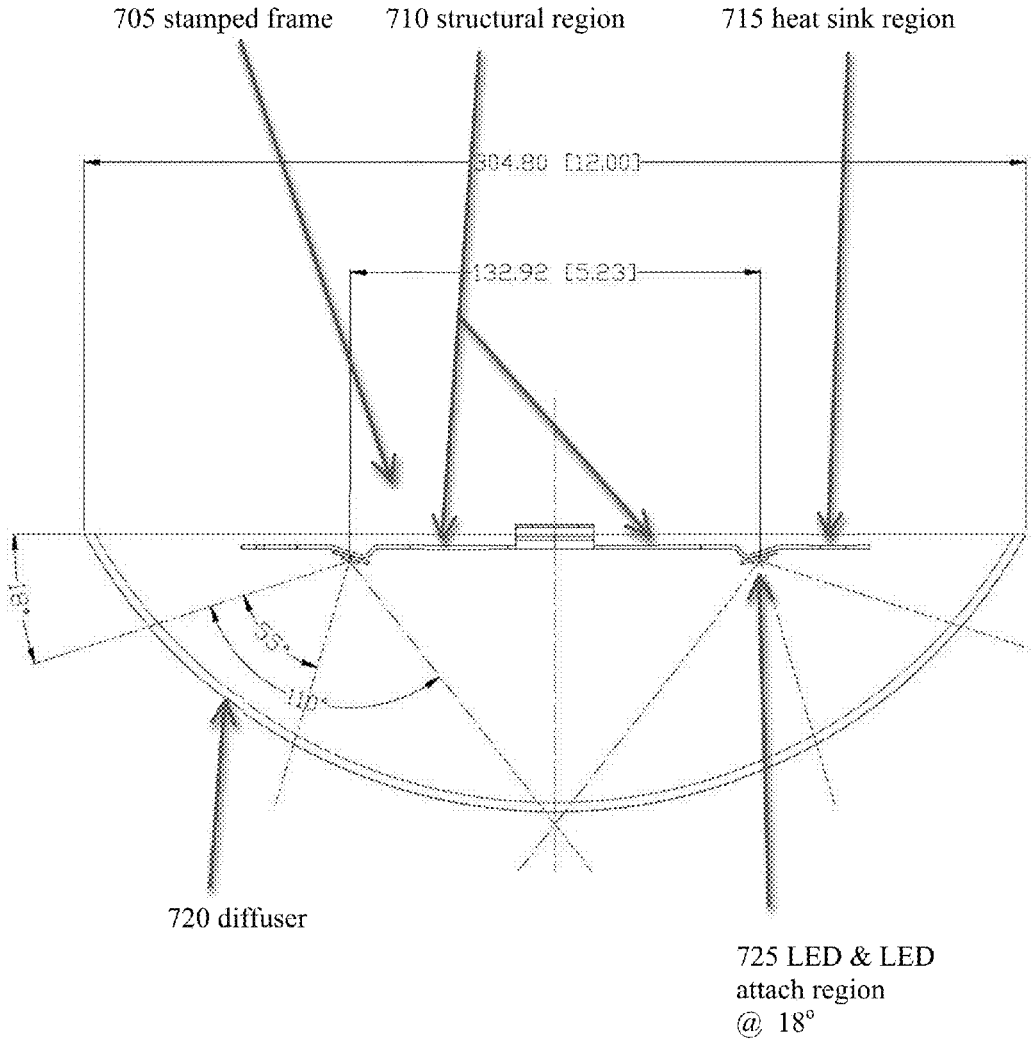

LED LIGHT APPARATUS

PRIORITY

This application claims priority from U.S. Provisional Application 61/641,701 filed on May 2, 2012.

CROSS-REFERENCE TO RELATED APPLICATIONS

This application has related material in U.S. Ser. No. 12/390,384, filed on Feb. 20, 2009 U.S. Ser. No. 12/431,728 filed on Apr. 29, 2009, U.S. Ser. No. 12/538,060 filed on Aug. 7, 2009, U.S. Ser. No. 12/571,395 filed on Sep. 30, 2009 and U.S. 61/724,659 filed on Nov. 9, 2012; all owned by the same assignee and incorporated herein in their entirety by reference.

BACKGROUND OF THE INVENTION

1. Field of the Invention

The disclosed invention relates to a LED based lighting apparatus comprising a low cost stamped frame comprising structural elements, LED attach region at a predetermined tilt angle and heat sink region enabling a lamp with uniform lighting distribution.

2. Description of Related Art

Putting an LED equivalent of a fluorescent bulb in a ceiling fixture with no air circulation presents a major problem of heat dissipation as well as achieving a uniform light distribution. There is no significant conduction heat path out of the fixture and very little possibility of natural convection. It is possible to conduct the heat away from the LEDs to a heat spreader and from there to the fixture and wiring but that simply results in raising the temperature of those components because there is no effective escape path to a cooler ambient. Since the air inside the fixture is confined on the top, there is no path for any natural convection and the stagnant hot air remains in place. The problem can be solved in either of two fundamental ways. The instant invention is also applicable to designs other than those satisfying the PAR 38 ANSI requirements; in general any light source utilizing one or more LED's can utilize the features disclosed herein.

Background material is found in U.S. 2010/0214779; U.S. Pat. No. 7,722,221; U.S. 2008/0094837; U.S. 2009/0261706; U.S. Pat. No. D608,928; U.S. Pat. No. D614,323; U.S. Pat. No. D615,223; U.S. Pat. No. D627,905; U.S. Pat. No. 6,422,721; U.S. Pat. No. 6,908,212; U.S. Pat. No. 7,018,070; U.S. Pat. No. 7,234,842; Osram data sheet: [http://catalog.osram-os.com/catalogue/catalogue.do?favOid=00000003000004350634002 3&act=showBookmark] (Apr. 30, 2013); all incorporated herein in their entirety by reference.

BRIEF SUMMARY OF THE INVENTION

The instant invention discloses a LED lighting apparatus. Lamps, optionally circular, are designed to function with unusually uniform illumination over a hemisphere or other curved surface such as circular or square, plastic or glass, globe or other diffuser. Applications include ceiling lights, lights with fans, standing lamps and applications where uniformity of light distribution across a diffuser is a concern. Typical configurations include operation from 90 VAC to 305 VAC. Two optional lamp configurations, without diffusers are shown in FIGS. 3A and 3B. Light distribution from an incandescent bulb, conventional LED and LED of the disclosed invention is illustrated in FIGS. 1A, B and C respectively; note that the light uniformity of the instant invention is better than +/−5%.

In disclosed embodiments LED lamps, typically called Solid State Lighting, replace conventional light bulbs or florescent tubes. LEDs are Lambertian emitters; the distribution of light seen through a diffuser may not be uniform resulting in bright and dim spots; note FIGS. 1A, B and C. As disclosed herein, a lamp, using LED sources, placed at a predetermined tilt angle, θ, and at a predetermined radius can be configured to cast light in a very uniform pattern, meaning within +/−5%. As disclosed herein, a lamp comprises a flexible heat sink with an LED attachment region set at a predetermined tilt angle, θ, as shown in FIGS. 2A, B, C and D; optional configurations are shown in FIGS. 3A, B and C. In some embodiments, a Supplementary Heat Sink may be added in order to increase the total power of the lamp without over heating the LEDs. Other features comprise "Intelligent" capabilities such as auto-dimming, ambient light sensing, motion sensors, programmable controls; emergency lighting; smoke alarms and other features known to one knowledgeable in the art.

BRIEF DESCRIPTION THE DRAWINGS

FIGS. 1A, B and C are different light sources with different light uniformity.

FIGS. 2A and B is an exemplary metal stamped frame of the instant invention.

FIGS. 2C and D is an alternative exemplary metal stamped frame of the instant invention showing tilt angle and three regions.

FIGS. 3A and B are exemplary circular and polygonal lamps;

FIG. 3C is an exemplary metal frame with heat sink region and mounted LED die at 18° tilt angle.

FIG. 3D is an exemplary metal frame with heat sink region and mounted LED die at Θ° tilt angle.

FIG. 6A is a schematic illustration of light rays from an LED ring source with LEDs at a tilt angle of 0°;

FIG. 6B is a schematic illustration of light rays from an LED ring source with LEDs at a tilt angle of 30°.

FIG. 7 is a schematic drawing stamped frame showing structural region, heat sink region, LED attach region and diffuser.

DETAILED DESCRIPTION OF THE INVENTION

Figure 1A:
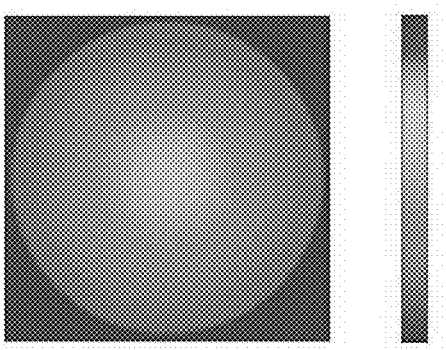
Figure 1B:
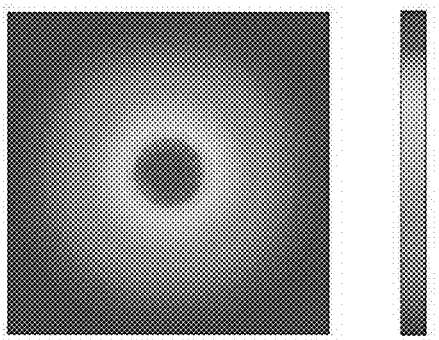
Figure 1C:
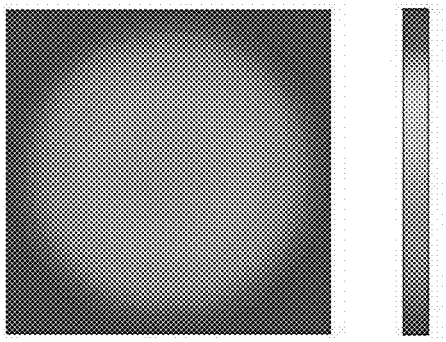

FIGS. 2A and B show a metal frame after stamping with no formed LED attach region. The material shown is aluminum alloy about 1-3 mm thick. Other materials are acceptable, including copper, copper alloys, graphite, pyrolytic carbon and carbon composites. In general the bulk material of the metal frame must exhibit a bulk thermal conductivity of at least 2.3 $Wcm^{-1\circ}K^{-1}$ and the area ratio of the heat sink region to the area of the entire metallic frame is at least 30% or greater such that the Θjc of the LED die junction to metal frame heat sink is less than about 75° C. at 100% rated power and an ambient temperature of 30° C. FIG. 2C shows a metal frame after stamping with a tilt angle, Θ, formed into the metal frame for LED attach; FIG. 2D shows the three regions of a metal frame, the structural region 205, LED attach region 210 and the heat sink region 215.

FIG. 3A shows an exemplary circular lamp with stamped metal frame; FIG. 3B shows an exemplary hexagonal shaped lamp with stamped metal frame and LED under a transparent, protective cover. FIG. 3C shows metal frame 301 with heat sink and LEDs 305 attached at Θ equal about 18°. FIG. 3D is another view with LEDs attached at Θ. Without this tilt, traditional diffusers would show hot-spotting and shadowing on the sides of the diffuser.

Figure 4A:
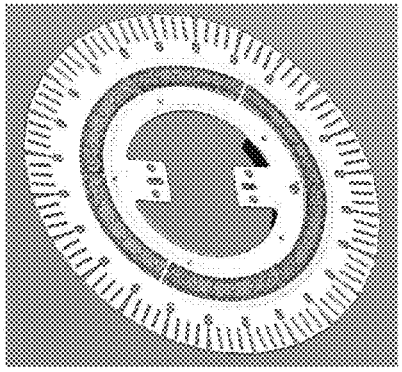
FIG. 4A shows a straight-cut metal frame with straight heat sink.
Figure 4B:
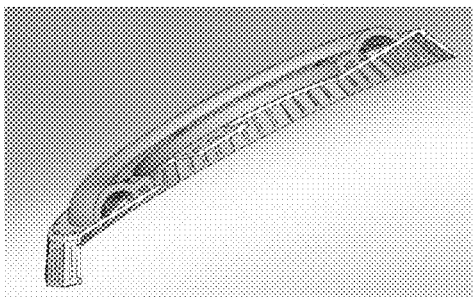
FIG. 4B shows a metal frame with bent heat sink and diffuser over LEDs.
Figure 4C:
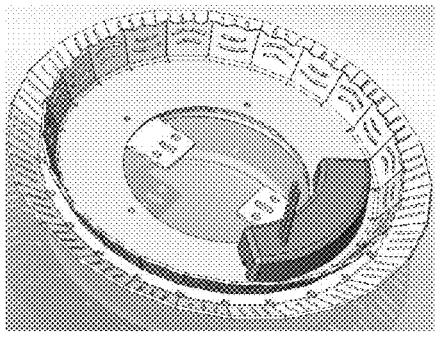
FIG. 4C shows a supplementary heat sink added to underside of metal frame 4B.

The angle Θ is achieved through the use of metal frame material, FIGS. 2A and 4A, optionally aluminum or aluminum alloy, of appropriate malleability or ductility. Predetermined tilt angle Θ is formed through a series of die-pressing stages, maintaining the thermal continuity of the metal frame, FIGS. 2B and 4B. The disclosed metal frame of this invention comprises an integrated thermal heat sink and allows for a supplemental heat sink when needed as shown in FIGS. 4C and 7. Thus, thermal requirements for the mass of the heat sink remain unchanged, as there is no interruption of the thermal continuity of the heat sink. Conventional designs in use today include an additional construction that adds an additional thermal interface. This additional interface requires another mechanical construction and the thermal conduction losses inherent in such a construction. Thus, the thermal efficiency of the conventional design compared to the continuous thermal mass of the disclosed metal frame with integral heat sink is always less; conventional design requires additional materials and manufacturing steps increasing cost of materials and resulting in a decrease thermal performance and life-time of the LED's.

Figure 5A:
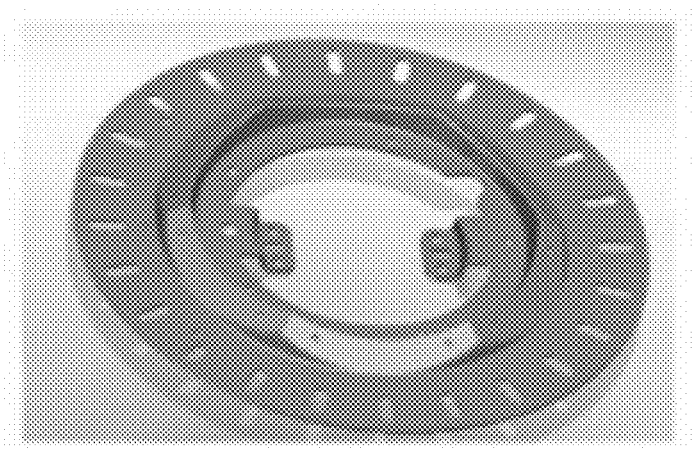
FIG. 5A is a drawing of alternative metal frame with tilt angle.
Figure 5B:
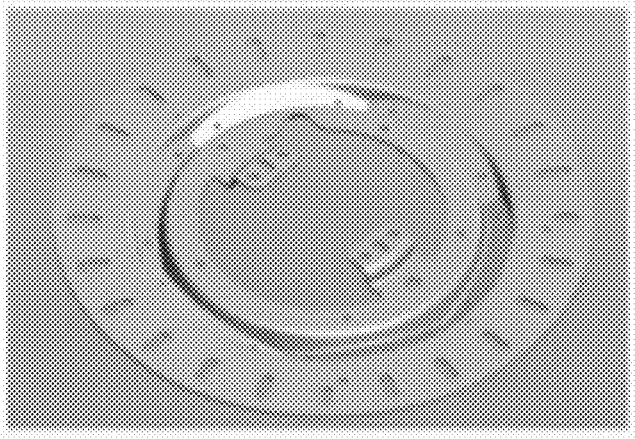
FIG. 5B is underside of 5A.
Figure 5C:
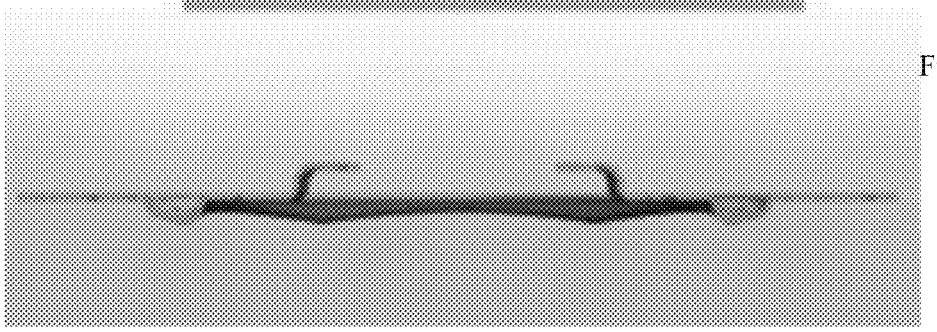
FIG. 5C is a drawing of edge on view of 5A showing tilt angle for LED attach.

FIGS. 5A, B and C show alternative views of another exemplary metal frame. By incorporating the use of the die-pressed angle θ, standard packaged LEDs such as Osram Duris E-5 LCW JDSH.EC and/or Samsung SMD 2323 and/or equivalent LEDs, can be used. Due to the die-pressed angle θ this device may be built with automated, surface mount, manufacturing methods; attachment to the metal frame element may be done with screws, rivets, thermal epoxy, or tapes. By forming a predetermined tilt angle θ in the metal frame, at the predetermined radius, a light diffuser is fully and uniformly illuminated with a light uniformity of at least +/−5%. It is not obvious to a user that the source of illumination is LEDs. The disclosed embodiments successfully simulates traditional lighting performance of isotropic sources such as incandescent filament and flourescent bulbs, while allowing for cost effective automated manufacturing used on typical LED assemblies and light sources. FIGS. 6A and B compare the light rays from an LED source with zero tilt angle, 6A, versus light rays from a LED source with 30° tilt angle Θ. The configuration of FIG. 6A results in a non-uniform light distribution; the overlapping of the light patterns in FIG. 6B results in a uniform light pattern. In general LEDs are tilted on the metal frame mounting base in such a way that is symmetrical about a central axis; the LEDs are mounted flat in the LED attach region and are in thermal contact with the mass of the metal frame and heat sink portion. This is achieved by forming the metal frame in a specific profile to achieve the required tilt angle. In FIGS. 5A, B and C note the formed area created from the die-press operation. The raised surface is at angle θ from the plane of the heat sink portion providing uniform illumination, and un-broken thermal continuity to the mass of the heat sink; multi-staged, metal forming die-press tools are used for minimum built-in stresses, or breakthroughs in the metal. FIG. 5B shows these angles from the bottom of the device. FIG. 5C shows a side view of the recess that results from the die-press multi stage operation. The flat area allows for standard mounting of surface mount LEDs at angle θ to the plane of the rest of the metal frame elements.

Standard surface mount LED's radiate through spherical angle of 110° onto a semi-spherical element. Since LED's radiate in a Lambertian distribution, the least flux density occurs at the widest angle. Therefore the bottom and sides of a target diffuser receive the least flux density. With a zero degree tilt angle θ the outermost rays of the LED's provide decreasing flux density incident on the sides and bottom of a diffuser. With the LED's mounted on the die-pressed surface at angle θ greater than 3 degrees there is more flux incident across the diffuser surface, with a clear improvement of both the bottom and side of the diffuser. FIG. 6B shows how, across the entire 180 degrees of the LED's Lambertian radiation pattern, the tilt at angle θ allows full illumination of the diffuser. And since the LEDs are mounted at angle θ in symmetrical pattern about a central axis shared by the diffuser the illumination successfully simulates that of traditional bulb light sources. Lambertian sources emit flux density into a sphere which varies as the cosine of the angle. Sixty percent of the energy is contained within the solid angle of +/−45 degrees (0.707×45°).

FIG. 6A shows an 18 inch spherical diffuser bowl target illuminated with LED's at a angle θ of zero degrees. In this case, the outermost rays are intersecting the diffuser bowl walls with the lowest flux density on the sides, and bottom of the diffuser. This results in hot spotting in a ring pattern visible at the on axis highest flux density point shown with the arrow, and the lowest flux density showing at the edges and center of the diffuser sphere. FIG. 6B shows the same 18 inch spherical diffuser with the LED's mounted at angle θ at 30°. The result is higher flux density on the sides, and an increase in flux density at the center of the diffuser sphere.

FIG. 7 shows stamped frame 705 with a diameter of about 8 in.; LED and LED attach region 715 are located at a radius of about 2.615 in., a diameter of 5.23 in., from the center line; LEDs are attached at a Θ of about 18°. Diffuser 720 is a portion of a hemisphere in this embodiment. Structural region 710 and heat sink region 715 are also indicated.

Figure 8:
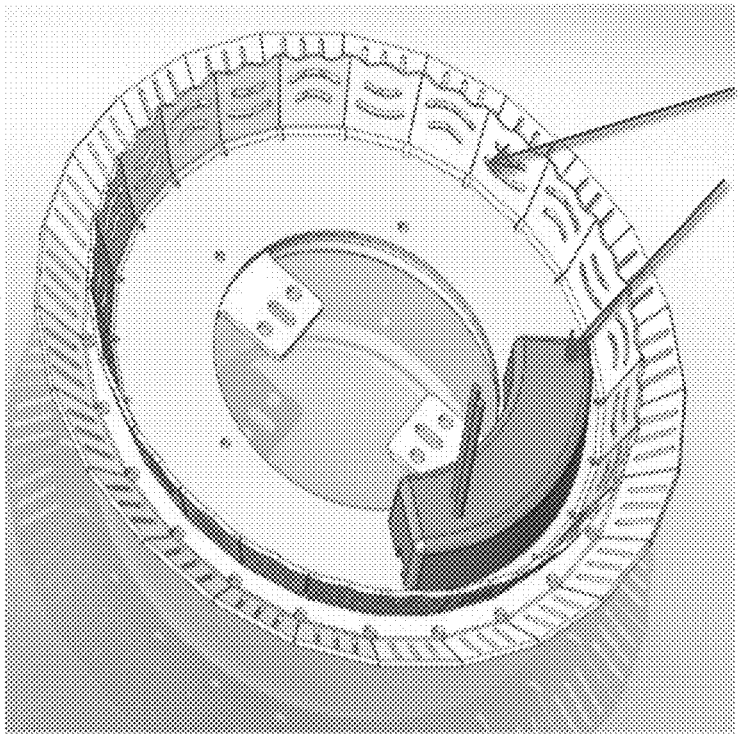
FIG. 8 is a schematic illustration of a stamped frame showing integrated and supplemental heat sinks.

FIG. 8 shows that additional power densities can be achieved within the same dimensional constraints shown in FIG. 5 by including a second thermal element shown here. Therefore, increased flux density can be achieved while maintaining the same constraints on the overall diameter of the assembly.

As used herein a diffuser is any device that diffuses or spreads out or scatters light in some manner, to give soft light. Diffuse light can be easily obtained by making light to reflect diffusely from a white surface, while more compact optical diffusers may use translucent objects, and can include ground glass diffusers, teflon diffusers, holographic diffusers, opal glass diffusers, and greyed glass diffusers. A Perfect (Reflecting) Diffuser (PRD) is a theoretical perfectly white surface with Lambertian reflectance (its brightness appears the same from any angle of view). It does not absorb light, giving back 100% of the light it receives. For purposes of the disclosed invention the diffusers of interest are those with symmetry about a central axis; optional shapes include, hemispheres, portions of a spherical surface, parabolic surfaces and others commonly used in lighting fixtures.

Examples of means for powering the LEDs include commercially available LED power supply/driver chipsets, or external LED driver power supplies; optionally means for powering is done with a current source. The means for powering can be modulated by one or more methods chosen from a group consisting of external dimmer triacs or other types of rheostat, remote control apparatus and adjustable rheostat on the lamp fixture such that the light intensity of the plurality of LEDs is modulated accordingly. In some embodiments the means for powering is configured such that the current to individual LEDs of the plurality of LEDs is controllable.

Examples of means for temperature sensing include use of a thermocouple or temperature sensing integrated circuit in combination with circuitry in the power supply/driver that will automatically lower the power supplied to the LED's in the event that the LED junction temperature exceeds predetermined set points. This temperature sensing feedback control ensures that LED's remain at or below their maximum operating temperatures. This circuitry, along with the effective circuit design referenced here, allows the LED's to consistently operate at predetermined flux outputs and predetermined temperatures which may be different than the manufacturer's ratings.

Examples of a means for controlling are programmable controllers, such as programmable logic controllers or microcomputers, wherein the means for controlling is in communication with the means for sensing the temperature and the means for powering such that the means for controlling can adjust the means for powering based upon the temperature communicated by the means for sensing the temperature to limits preset in the means for controlling.

In some embodiments an apparatus for lighting comprises a plurality of LEDs; a stamped frame symmetrical about a central axis comprising a structural region, a LED attachment region and a heat sink region; and a diffuser symmetrical about the central axis; wherein the diameter of the LED attachment region varies between about 0.30 and 0.90 of the diameter of the diffuser and wherein the stamped frame is configured such that the LED attachment region is tilted up from the structural region such that the LEDs are facing outward, toward the outer perimeter of the stamped frame, at an angle θ between about 3° and 85° from the horizontal; optionally, at an angle θ between about 10° and 75° from the horizontal; optionally, at an angle θ between about 15° and 60° from the horizontal; optionally, the diffuser has a radius between about 3 in. and about 20 in.; optionally, the plurality of LEDs are attached to the LED attachment region of the stamped frame with the LED attachment region tilted up from the structural region at an angle θ between about 3° and about 85° and wherein the LED die-to-die spacing is about 1 mm or greater; optionally, the stamped frame has a thickness between about 1 mm and 3 mm and is of a composition whose bulk thermal conductivity is at least 2.3 $Wcm^{-1\circ}K^{-1}$ and the area ratio of the heat sink region to the area of the entire stamped frame is at least 30% or greater such that the Θjc of the LED die is less than about 75° C. at 100% rated power, wherein the Θjc of the LED die is taken as the temperature difference between the LED die junction temperature, j, and the temperature of a heat sink fin of the metal frame, c; optionally, the apparatus further comprises means for powering the LEDs with a current source wherein the LED's are driven at a current no more than 95% of the manufacturer's rated maximum; optionally, the means for powering can be modulated by one or more means chosen from a group consisting of external dimmer rheostat, standard triac dimmer, remote control apparatus, adjustable rheostat on the lamp fixture such that the light intensity of the plurality of LEDs is modulated accordingly; optionally, the apparatus further comprises means for temperature sensing of at least one spot of the heat sink region wherein the temperature of the spot monitored has been correlated to the junction temperature of one of the plurality of LEDs; optionally, the apparatus further comprises a means for controlling wherein the means for controlling is in communication with the means for temperature sensing and the means for powering such that the means for controlling can adjust the means for powering based upon the temperature communicated by the means for temperature sensing; optionally, the means for powering is configured such that the current to individual LEDs of the plurality of LEDs is controllable; optionally, the plurality of LEDs comprises a plurality of white, red, blue and yellow LEDs.

All patents, patent applications, and other documents referenced herein are incorporated by reference in their entirety for all purposes, unless otherwise indicated.

Foregoing described embodiments of the invention are provided as illustrations and descriptions. They are not intended to limit the invention to precise form described. In particular, it is contemplated that functional implementation of invention described herein may be implemented equivalently. Alternative construction techniques and processes are apparent to one knowledgeable with integrated circuits, light emitting devices, hybrid assembly, flexible circuits and luminaire technologies. Other variations and embodiments are possible in light of above teachings, and it is thus intended that the scope of invention not be limited by this Detailed Description, but rather by Claims following.

We claim:

1. An apparatus for lighting comprising;

a plurality of LEDs;

a stamped frame symmetrical about a central axis comprising a structural region, a LED attachment region and a heat sink region; and a diffuser symmetrical about the central axis; wherein the diameter of the LED attachment region varies between about 0.30 and 0.90 of the diameter of the diffuser and wherein the stamped frame is configured such that the LED attachment region is tilted up from the structural region such that the LEDs are facing outward at an angle θ between about 3° and 85° from the horizontal.

2. The apparatus of claim 1 wherein the diffuser has a radius between about 3 in. and about 20 in.

3. The apparatus of claim 1 wherein the plurality of LEDs are attached to the LED attachment region of the stamped frame with the LED attachment region tilted up from the structural region at an angle θ between about 3° and about 85° and wherein the LED die-to-die spacing is about 1 mm or greater.

4. The apparatus of claim 1 wherein the stamped frame has a thickness between about 1 mm and 3 mm and is of a composition whose bulk thermal conductivity is at least 2.3 $Wcm^{-1\circ}K^{-1}$ and the area ratio of the heat sink region to the area of the entire stamped frame is at least 30% or greater such that the Θjc of the LED die is less than about 75° C. at 100% rated power.

5. The apparatus of claim 1 further comprising means for powering the LEDs with a current source wherein the LED's are driven at a current no more than 95% of the manufacturer's rated maximum.

6. The apparatus of claim 5 wherein the means for powering can be modulated by one or more means chosen from a group consisting of external dimmer rheostat, standard triac dimmer, remote control apparatus, adjustable rheostat on the lamp fixture such that the light intensity of the plurality of LEDs is modulated accordingly.

7. The apparatus of claim 1 further comprising means for temperature sensing of at least one spot of the heat sink region wherein the temperature of the spot monitored has been correlated to the junction temperature of one of the plurality of LEDs.

8. The apparatus of claim 7 further comprising a means for controlling wherein the means for controlling is in communication with the means for temperature sensing and the means for powering such that the means for controlling can adjust the means for powering based upon the temperature communicated by the means for temperature sensing.

9. The apparatus of claim 5 wherein the means for powering is configured such that the current to individual LEDs of the plurality of LEDs is controllable.

10. The apparatus of claim 9 wherein the plurality of LEDs comprises a plurality of white, red, blue and yellow LEDs.

11. An apparatus for lighting comprising;

a plurality of LEDs comprising one or more colors;

a stamped frame symmetrical about a central axis comprising a structural region, a LED attachment region and a heat sink region wherein the stamped frame has a thickness between about 1 mm and 3 mm and is of a composition whose bulk thermal conductivity is at least 2.3 $Wcm^{-1\circ} K^{-1}$ and the area ratio of the heat sink region to the area of the entire stamped frame is at least 30% or greater such that the $\Theta jc$ of the LED die is less than about 75° C. at 100% rated power; and a diffuser symmetrical about the central axis; wherein the diameter of the LED attachment region varies between about 0.30 and 0.90 of the diameter of the diffuser and wherein the stamped frame is configured such that the LED attachment region is tilted up from the structural region such that the LEDs are facing the outer perimeter of the stamped frame at an angle θ between about 3° and 85° from the horizontal.

12. The apparatus of claim 11 wherein the angle θ is between about 10° and about 75°.

13. The apparatus of claim 11 wherein the angle θ is between about 15° and about 60°.

* * * * *